US009613761B2

(12) United States Patent
Bruchschmidt et al.

(10) Patent No.: US 9,613,761 B2
(45) Date of Patent: Apr. 4, 2017

(54) CONTACT ELEMENT

(71) Applicant: EATON ELECTRICAL IP GMBH & CO. KG, Schoenefeld (DE)

(72) Inventors: Frank Bruchschmidt, Dausenau (DE); Artur Wiese, Bornheim (DE)

(73) Assignee: EATON ELECTRICAL IP GMBH & CO. KG, Schoenefeld (DE)

( * ) Notice: Subject to any disclaimer, the term of this patent is extended or adjusted under 35 U.S.C. 154(b) by 0 days.

(21) Appl. No.: 15/105,585

(22) PCT Filed: Dec. 16, 2014

(86) PCT No.: PCT/EP2014/077980
§ 371 (c)(1),
(2) Date: Jun. 17, 2016

(87) PCT Pub. No.: WO2015/091497
PCT Pub. Date: Jun. 25, 2015

(65) Prior Publication Data

US 2016/0307710 A1 Oct. 20, 2016

(30) Foreign Application Priority Data

Dec. 19, 2013 (DE) ..... 10 2013 114 434

(51) Int. Cl.
*H01H 1/20* (2006.01)
*H01H 13/50* (2006.01)
*H01H 13/52* (2006.01)

(52) U.S. Cl.
CPC ..... *H01H 1/20* (2013.01); *H01H 13/503* (2013.01); *H01H 13/52* (2013.01); *H01H 1/2008* (2013.01)

(58) Field of Classification Search
CPC ..... H01H 13/52; H01H 1/20
(Continued)

(56) References Cited

U.S. PATENT DOCUMENTS 6,198,058 B1 * 3/2001 Graninger ..... H01H 13/02 200/16 R
7,605,337 B2 * 10/2009 Scherl ..... H01H 3/022 200/16 A (Continued)

FOREIGN PATENT DOCUMENTS

DE 3340658 A1 5/1985
DE 19856678 A1 4/2001

(Continued)

*Primary Examiner* — Edwin A. Leon
(74) *Attorney, Agent, or Firm* — Leydig, Voit & Mayer, Ltd.

(57) ABSTRACT

A contact element which, on account of its low installation depth, is suitable for use in switch panels of low overall height and can be combined with various keys. The contact element has a main body, two connection terminals, which are obliquely mounted in the main body, for electrical conductors, two busbars which are in each case electrically connected to one of the connection terminals and run from the respective connection terminal to a bearing arranged centrally in the main body. A tappet which is spring-mounted in the central bearing can be moved between a first and a second position and is fitted with a contact bridge which electrically short-circuits the two busbars in one of the two positions, wherein a portion of the tappet, which portion projects out of the main body, is designed to be coupled to a key.

10 Claims, 5 Drawing Sheets

(58) Field of Classification Search
USPC ..... 200/243, 293–296, 18, 341, 329, 321, 200/307, 50.02, 43.07, 16 R, 16 C, 17 R, 200/43.01, 43.04, 50.01, 50.06; 439/530
See application file for complete search history.

(56) References Cited

U.S. PATENT DOCUMENTS

| | | | | |
|---|---|---|---|---|
| 7,943,872 | B2 * | 5/2011 | Scherl | H01H 9/22 200/43.04 |
| 2004/0245083 | A1 | 12/2004 | Sambar et al. | |

FOREIGN PATENT DOCUMENTS

| | | | |
|---|---|---|---|
| DE | 102005009722 | A1 | 9/2006 |
| DE | 602004004457 | T2 | 10/2007 |
| EP | 2600368 | A1 | 6/2013 |
| EP | 2645391 | A1 | 10/2013 |

* cited by examiner

CONTACT ELEMENT

CROSS-REFERENCE TO RELATED APPLICATIONS

This application is a U.S. national stage application under 35 U.S.C. §371 of International Application No. PCT/EP2014/077980, filed on Dec. 16, 2014, and claims benefit to German Patent Application No. DE 10 2013 114 434.9, filed on Dec. 19, 2013. The International Application was published in German on Jun. 25, 2015, as WO 2015/091497 A1 under PCT Article 21(2).

FIELD

The invention relates to a contact element which, due to its shallow installation depth, is particularly suitable for use in control panels or boards of a low overall height, and which can be combined with various buttons.

BACKGROUND

Contact elements of this kind are used in command and signaling devices such as the applicant's RMQ-Titan® product series. In this regard, reference is made in particular to the product series M22-Titan and the contact elements M22-K10 or M22-K01. In addition, the European patent application EP 2 645 391 A1 discloses a switching apparatus and a switching contact which have a relatively low overall height and for which the contact element is cylindrical and parts of the contact element are arranged on a printed circuit board.

The German Offenlegungsschrift DE 33 40 658 A1 discloses a contact element for which terminals are obliquely mounted in the main body thereof, as a result of which the terminals are easily accessible for electrical leads even in the assembled state of the contact element.

The German Offenlegungsschrift DE 198 56 678 A1 describes an easily mountable contact element for an electrical switching device, in which a plunger is designed to actuate such that a contact bridge mounted in the plunger can be arranged on the plunger in two different positions which are axially spaced apart from one another.

SUMMARY

An aspect of the invention provides a contact element, comprising: a main body; a first terminal and a second terminal, suitable for electrical conductors, which terminals are obliquely mounted in the main body; a first busbar and a second busbar, each electrically connected to one of the terminals and extending from the respective terminal to a central bearing arranged centrally in the main body; and a plunger, which is spring-mounted in the central bearing, the plunger being moveable between a first and a second position and the plunger supporting a contact bridge, which electrically short-circuits the first and second busbars in one of the two positions, wherein a part of the plunger protruding from the main body is configured to couple to a button, wherein the plunger includes a central hole and a side hole, provided beside the central hole, wherein the central hole is configured to receive and mount a contact spring, which contact spring exerts a spring pressure on the contact bridge, wherein the side hole is configured to receive and mount a return spring, which return spring presses the plunger into the first or second contact position, wherein the contact bridge is mounted in the central hole, wherein the plunger includes an elongate opening in each of two opposite sides, through each of which contact ends of the contact bridge protrude, and wherein the plunger includes on an underside thereof, on each of the two opposite sides, an assembly for installing the contact bridge.

BRIEF DESCRIPTION OF THE DRAWINGS

The present invention will be described in even greater detail below based on the exemplary figures. The invention is not limited to the exemplary embodiments. All features described and/or illustrated herein can be used alone or combined in different combinations in embodiments of the invention. The features and advantages of various embodiments of the present invention will become apparent by reading the following detailed description with reference to the attached drawings which illustrate the following.

DETAILED DESCRIPTION

Figure 1:
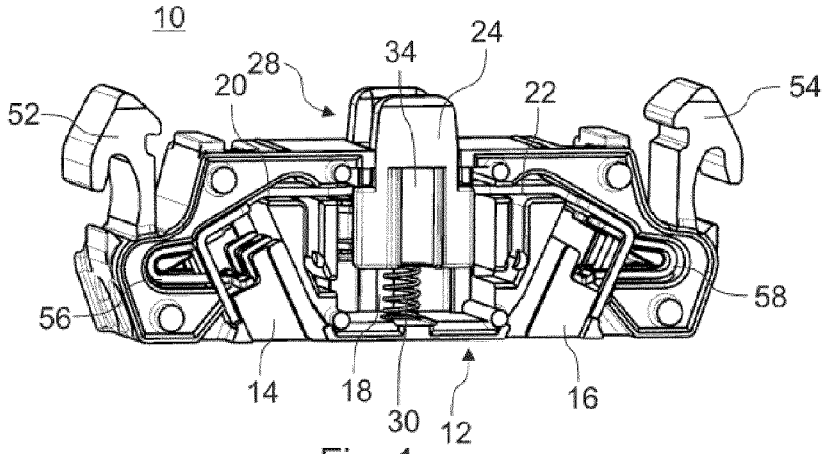
FIG. 1 is a sectional view of an embodiment of a NC contact element according to the invention.

An aspect of the present invention provides a contact element having a comparatively low installation depth and for which, in addition, the assembly is further simplified A concept underlying an aspect of the present invention is that of achieving a compact design of a contact element by obliquely mounting terminals for electrical conductors in the main body of the contact element. The installation depth of the contact element can be advantageously reduced in comparison with conventional contact elements by the oblique position of the terminals. In addition, for simplified assembly, a plunger supporting a contact bridge comprises on its underside, on each of two opposite sides having elongate openings through each of which contact ends of the contact bridge protrude, an assembly opening for installing the contact bridge. The assembly openings can be in the shape of small slits, which open the elongate openings towards the bottom of the plunger.

An embodiment of the invention relates to a contact element comprising a main body, two terminals for electrical conductors, which terminals are obliquely mounted in the main body, two busbars, each electrically connected to one of the terminals and extending from its terminal to a bearing arranged centrally in the main body, and a plunger which is spring-mounted in the central bearing, is moveable between a first and a second position and supports a contact bridge, which electrically short-circuits the two busbars in one of the two positions, wherein a part of the plunger protruding from the main body is designed to couple to a button. Depending on how the contact bridge is mounted and how the busbars in the main body extend to the contact bridge, the contact element can be designed as a normally closed contact (NC) or as a normally open contact (NO). Therefore, not only is a contact element produced that has a low installation depth, but also one that can be used as a normally closed contact or as a normally open contact, owing to the structural design of the plunger and the busbars. The part of the plunger that protrudes from the main body and is designed to couple to a button can in particular be formed such that it can be coupled to various buttons, in particular by various buttons being able to be placed thereon. The plunger comprises a central hole and at least one side hole provided beside the central hole, wherein the central hole is provided for receiving and mounting a contact spring, which exerts a spring pressure on the contact bridge, and the at least one side hole is provided for receiving and mounting a return spring, which presses the plunger into the first or second contact position. The contact bridge is mounted in the central hole and the plunger comprises an elongate opening in each of two opposite sides, through each of which contact ends of the contact bridge protrude. The elongate openings mean that the contact bridge can be mounted in different positions in the plunger, as a result of which the plunger having the contact bridge mounted in a corresponding position can be designed for the contact element functioning as either a normally closed contact or a normally open contact. The plunger comprises on its underside, on each of the two opposite sides having the elongate openings, an assembly opening for installing the contact bridge. The assembly openings can be in the shape of small slits which open the elongate openings towards the bottom of the plunger. When assembling the plunger with the springs and the contact bridge, this makes it possible for the contact bridge to be easily inserted into the central hole in such a way that the ends thereof can protrude through the elongate openings.

The contact bridge can be spring-mounted in the plunger, as a result of which a soft stop of the plunger can be achieved when said plunger is actuated, for example by means of a button.

The plunger can comprise two side holes that are arranged symmetrically with the central hole. As a result, the return spring can be inserted on either side into one of the side holes in the plunger, meaning that the plunger does not have to be assembled in a precise position.

On each of two of its opposite sides, the main body can comprise a latching hook, which makes it possible to clampingly attach the contact element to a subbase or in an opening in a panel.

The contact element can be designed for front attachment, the part of the plunger protruding from the main body being positioned on a side of the main body facing the latching hooks, which are oriented in the same direction. The side facing the latching hooks is understood here to be the side which can be seen when the contact element is attached by the latching hooks, thus for example if the contact element is intended to be attached by the latching hooks to the front panel of a control panel or board. Alternatively, the contact element can be designed for bottom attachment, the part of the plunger protruding from the main body being positioned on a side of the main body facing away from the latching hooks, which are oriented in the same direction. By bottom attachment, here the opposite to front attachment is understood, thus attachment of the contact element by the latching hooks to the bottom of a housing or a DIN rail, for example.

In particular, the contact element can be designed such that its installation depth remains below 30 mm, and in particular is approximately 14 mm. Contact elements having an installation depth thus reduced can be used in panels having a low overall height, for example.

Further advantages and possible applications of the present invention can be found in the following description in connection with the embodiments shown in the drawings.

In the following description, identical, functionally identical and functionally related elements are provided with identical reference signs. Absolute values are only given in the following by way of example and are not to be understood to limit the invention.

An aim of the present invention is to provide a contact element, in particular for front attachment, which has as low an installation depth as possible, which in particular remains below approximately 30 mm, in comparison with an installation depth of 45 mm of conventional contact elements. The present invention can even provide a contact element of which the installation depth is only approximately 14 mm, as a result of which a switch space comprising the contact element according to the invention can be reduced in size from 26.2 mm to approximately 10.7 mm.

FIG. 1 is a sectional view of a NC contact element 10 according to the invention comprising lateral latching hooks 52 and 54 for clamping attachment for example to a subbase or in an opening in a control panel or board.

Figure 10:
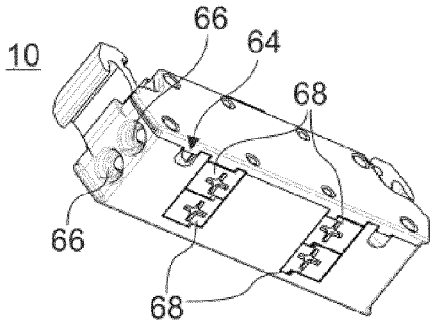

A left-hand and a right-hand terminal 14 and 16, respectively, for electrical conductors are obliquely mounted in the main body 12 of the contact element 10. The terminals and busbars on the right and left are identical parts, but fitted in a mirror image. This has the advantage that only one terminal is provided as NO and one terminal is provided as NC. The terminals 14 and 16 can be designed as "plug-clamping connections" having tool-free direct plugging (also called push-in terminals). In connection technology of this kind, rigid, fine-wired conductors having ferrule terminals can be inserted into the clamps without using tools, which reduces the wiring time, requires less installation space than screw terminals, for example, and less time and materials, generally produces less scope for error, and necessitates less monitoring during operation. Button actuators 68 of the terminals are provided on the underside of the main body 12 of the contact element 10 for inserting and fixing flexible conductors without ferrule terminals into the terminals 14 and 16 (see FIG. 10), which button actuators must be pressed in order to preload spring clamps 56 and 58 (identical parts), as a result of which channels of the terminals 14 and 16 are opened for inserting the conductors. The button actuators 68 must also be pressed in order to remove the conductors from the terminals 14 and 16. The button actuators 68 are designed such that they can be easily actuated using a screwdriver. The advantage of this kind of terminal 14 and 16 (spring terminal) is that no specific tools are required, such as a torque wrench, and thus the scope for error when connecting is reduced.

The compact design of the contact element 10 according to the invention is substantially achieved by the oblique mounting of the terminals 14 and 16 in the main body 12, busbars and the special switching contact mechanism consisting of a plunger that is spring-mounted and can be moved between two positions, as described in detail in the following.

From the two terminals 14 and 16, a left-hand and a right-hand busbar 20 and 22, respectively, (identical parts) lead in the main body 12 to a central bearing 18 for a plunger 24. The plunger 24 is movably mounted in the central bearing 18 such that it can be moved between a first and a second stop position. A return spring 30 presses the plunger 24 into the first (original) position, in which a part 28 of the plunger 24 that is intended to couple with a button and is designed accordingly protrudes fully from the main body 12. The plunger 24 supports a contact bridge, which is hidden by the plunger 24 in FIG. 1, and electrically short-circuits the left-hand and right-hand busbars 20 and 22 in the design of the contact element 10 shown in FIG. 1 as a normally closed contact (NC contact element) in the first position of the plunger 24. Owing to pressure on the plunger 24, which can be exerted by means of a button sitting on the protruding part 28 of the plunger 24, the plunger 24 is pushed down into the second position, against the force of the return spring 30, which is compressed. As a result, the contact bridge is moved down with the plunger 24, and therefore the electrical connection between the two busbars 20 and 22 is opened.

Figure 2:
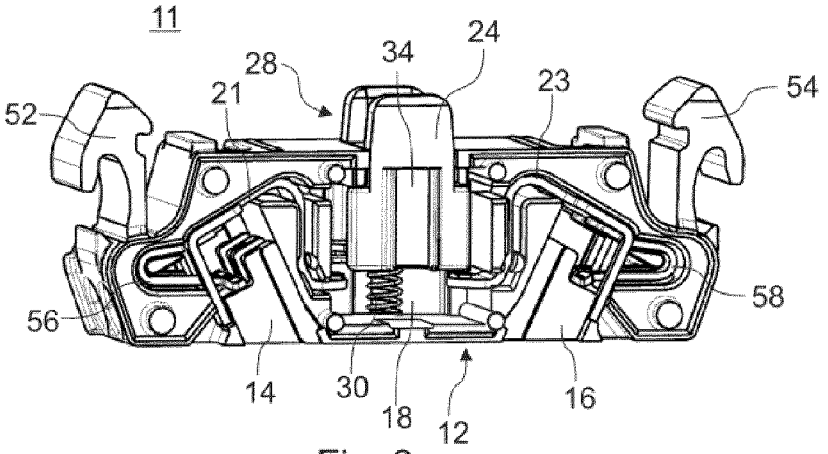
FIG. 2 is a sectional view of an embodiment of a NO contact element according to the invention.
Figure 3:
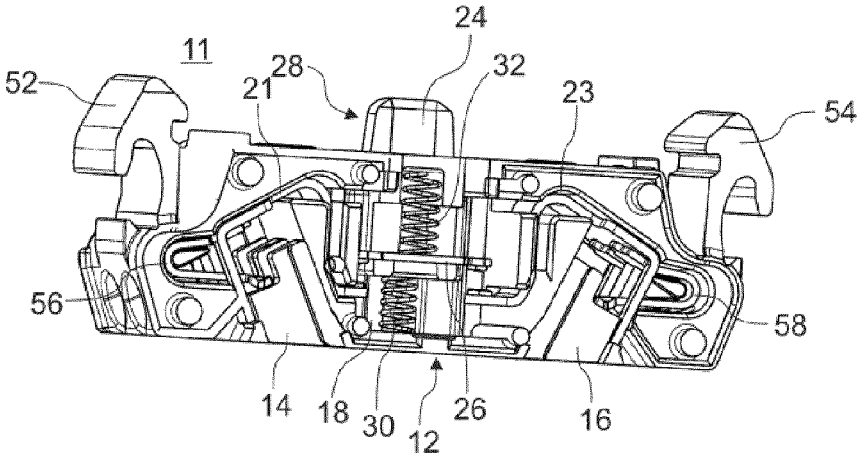
FIG. 3 is another sectional view of the NO contact element shown in FIG. 2.
Figure 4:
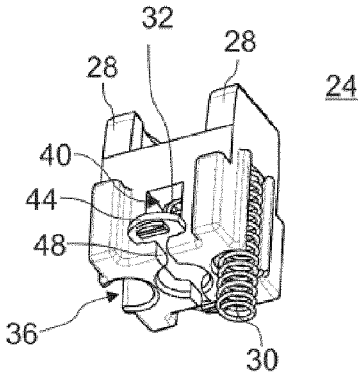
FIG. 4 is a perspective view of the plunger of the NO contact element shown in FIGS. 2 and 3 in the assembled form.

FIG. 2 is a sectional view of a NO contact element 11, which differs from the NC contact element shown in FIG. 1 on account of the busbars 21 and 23 (identical parts) and the mounting of the contact bridge 26 in the plunger, as follows: it can be seen in FIG. 2 that the busbars 21 and 23 are shaped differently to the busbars 20 and 22 in the contact element 10 shown in FIG. 1; specifically, they bend sharply downwards just before the central bearing 18, in order to end approximately at the lower part of the bearing 18 and protrude therein. FIG. 3 is also a sectional view of the plunger 24. Here it can be seen that the contact bridge 26 is spring-mounted in the lower part of the plunger 24 (a contact spring 32 is positioned in a central hole 34 (see FIG. 5) between the contact bridge 26 and the blind end of the central hole 34 at the upper end of the plunger 24). In the first position of the plunger 24, the contact bridge 26 is therefore in a position in which it cannot contact the two busbars 21 and 23. By pressing down the plunger 24 from the first into the second position, the contact bridge 26 is moved downwards with the plunger 24 and short-circuits the two busbars 21 and 23 from a specific position of the plunger 24 in the central bearing 18, and therefore the contact element 11 is closed.

FIGS. 4 to 7 show the structure of the plunger 24 in detail. The structure of the plunger 24 is designed such that only one mold is required for the use in a NC or NO contact element. In addition, the plunger 24 is designed in such a way that it can be completely pre-assembled as an assembly with the contact spring 32, the contact bridge 26 and the return spring 30. In particular, in the plunger 24, the return spring 30 is received such that it is held around the periphery and cannot fall out into the housing or the main body 12 of the contact element 10 and 11 during assembly. Moreover, the plunger 24 is designed in such a way that the return spring 30 can be inserted into the corresponding socket in the plunger 24 on both sides, as a result of which the assembly is simplified since the plunger does not have to be assembled in a precise position.

Figure 7:
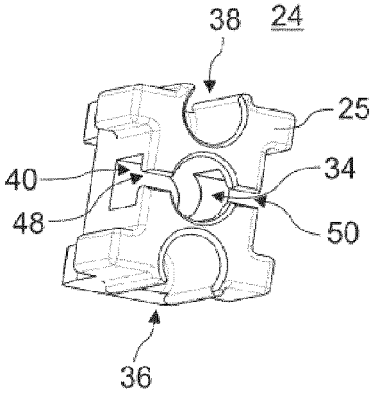
FIG. 7 is another perspective view of the plunger shown in FIG. 4 without springs and contact bridge.

First, the shape of the plunger 24 will now be explained with the aid of FIG. 7, which shows the plunger 24 in a perspective view from below: the roughly cuboid plunger 24 has a central hole 34 roughly in its center, which hole is made in the bottom 25 of the plunger 24 and ends in the plunger 24 as a blind hole. This central hole 34 is used for receiving the already-mentioned contact spring 32, which is used for spring-mounting the contact bridge 26 in the plunger 24. The contact spring 32 can be either clamped between the contact bridge 26 and the end of the central hole 34 in the plunger 24 (as for the NO contact element 11 shown in FIGS. 2 and 3), or inserted into the central hole 34 from the outside in order to press the contact bridge 26 against the end of the central hole (as for the NC contact element 10 shown in FIG. 1).

Two side holes 36 and 38 are provided symmetrically to the central hole 34 in the plunger 24 for the return spring 30, which side holes are open at the side and are also designed as blind holes, such that the return spring 30 inserted therein is stopped and cannot fall sideways out of the side holes 36 and 38 during the assembly of the contact element.

Figure 5:
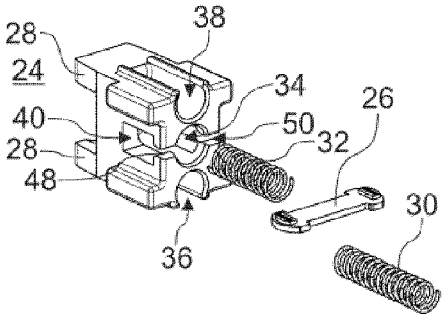
FIG. 5 is an exploded view of the plunger shown in FIG. 4.
Figure 6:
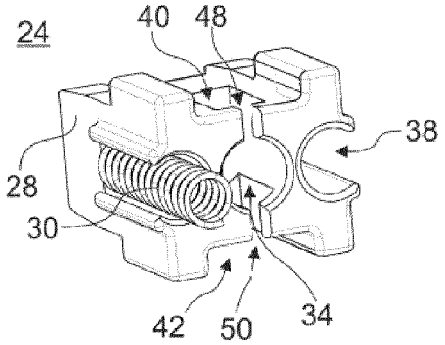
FIG. 6 is another perspective view of the plunger shown in FIG. 4 with a fitted return spring.

For mounting the contact bridge 26, the plunger 24 comprises, on each of two opposite sides thereof, one elongate rectangular opening 40 and 42, respectively, to the central hole 34. The two openings 40 and 42 in turn each comprise assembly openings 48 and 50, respectively, in the shape of small slits, which open the openings 40 and 42 towards the bottom 25 of the plunger 24. The flat, strip-shaped contact bridge 26 can be guided through these assembly openings 48 and 50 (as shown in FIG. 5) for assembling the plunger 24. Contact ends 44 and 46 of the contact bridge 26 then protrude from the two openings 40 and 42, and the contact bridge 26 can be moved back and forth inside the two openings. The arrangement of the contact spring 32 determines (as already explained above) the use of the plunger for a NC or NO contact element 10 or 11, respectively.

The contact bridge 26 can be designed such that it can be used as either a NC contact or a NO contact. For this purpose, it simply has to be fitted in the plunger 24 in a manner rotated through 180°. The otherwise conventional raised shaped portion in the center of the contact bridge 26 for centering the contact spring 32 can be omitted since the contact spring 32 is guided through the cylindrical surfaces of the central hole 34 of the plunger 24.

The part 28 of the plunger 24 protruding from the main body 12 of the contact element 10 and 11, which part comprises two projections in the embodiment of the plunger 24 shown in FIG. 4-7, can be adapted to contact elements that are currently available on the market in order to allow adaptation as a second level to the contact elements available.

Figure 8:
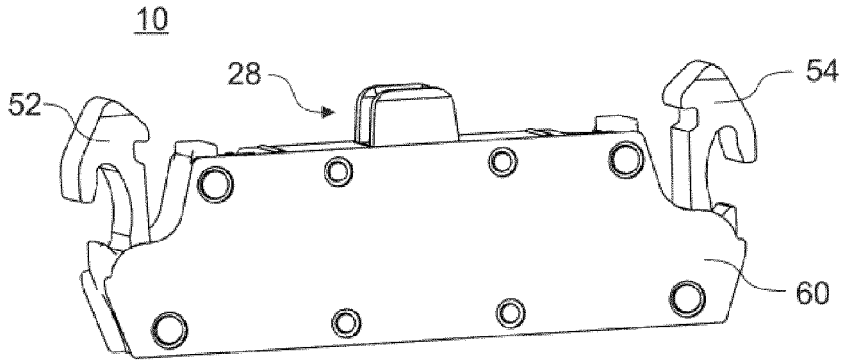
FIG. 8-10 are different perspective views of the fully assembled NC contact element shown in section in FIG. 1.
Figure 9:
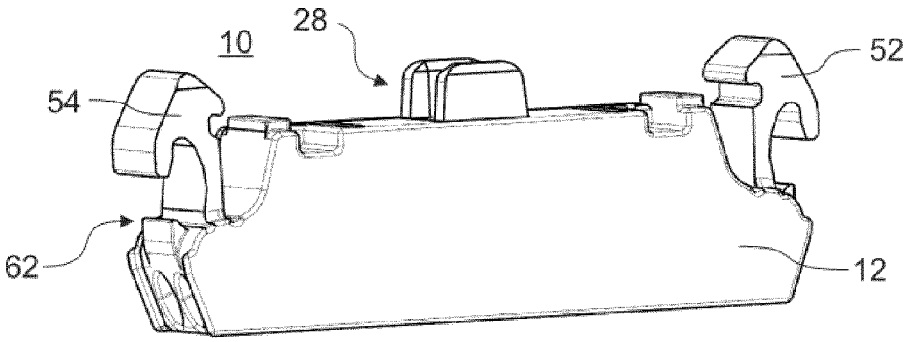

FIGS. 8 and 9 show the NC contact element 10 in the assembled state with the cover 60 placed on the main body 12. In the view from below of the contact element 10 shown in FIG. 10, the button actuators 68 for the release of the terminals of the contact element 10 can be seen. In addition, the conductor lead-ins 66 for the electrical conductors are provided on the side of the contact element 10, which electrical conductors are introduced into the terminals inside the contact element 10. The conductor lead-ins 66 are arranged obliquely in order to achieve quick and easy insertion and accessibility of the connection lines of the contact element 10.

Figure 11:
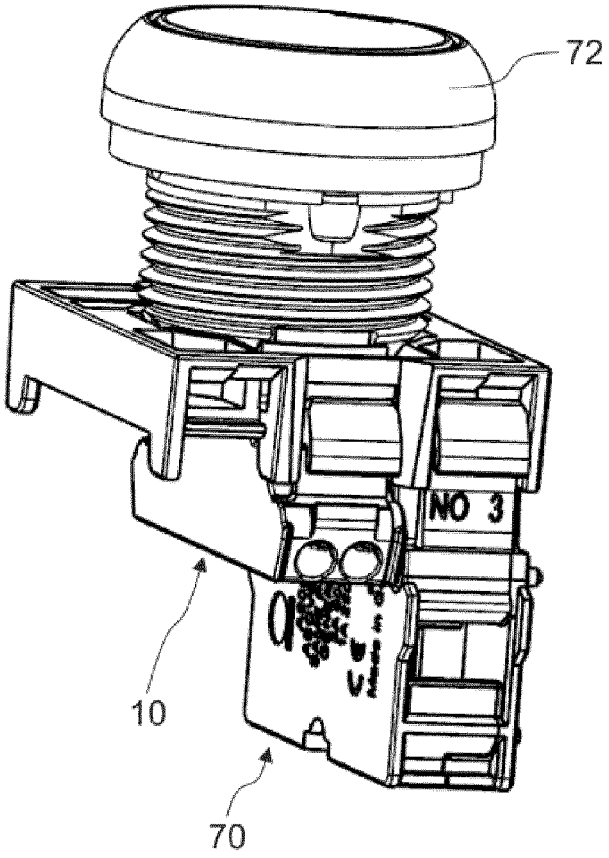
FIG. 11 is a perspective view of an embodiment of a contact element according to the invention with a button fitted, which beside a conventional contact element having a conventional installation depth.

Finally, FIG. 11 shows the contact element 10 according to the invention, which is arranged directly beside a conventional contact element 70 having a substantially larger installation depth, with a button 72 fitted by means of which the contact element 10 can be actuated. The substantially smaller installation depth of the contact element 10 according to the invention can thus clearly be seen, which depth makes it possible to produce control panels and boards having a clearly reduced installation depth.

Figure 12:
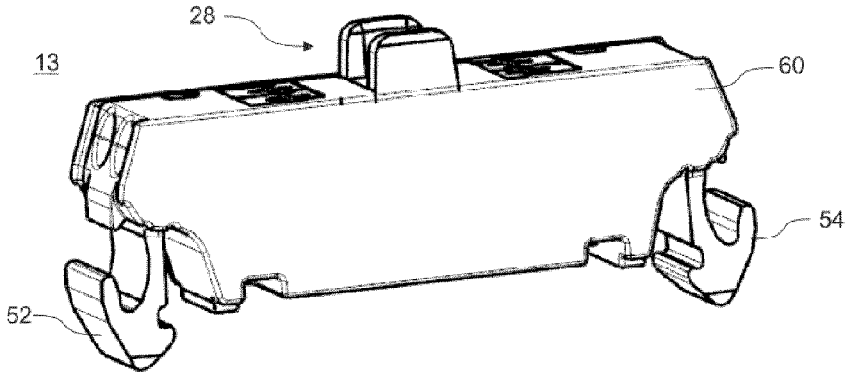
FIG. 12 is a perspective view of another embodiment of a fully assembled contact element for bottom attachment.

FIGS. 1 to 11 show contact elements which are provided for front attachment, for which the part 28 of the plunger 24 protruding from the main body 12 is positioned on the side of the main body which faces the two latching hooks 52 and 54, which are oriented in the same direction. These contact elements are provided in particular for attachment to control panels and boards by being pressed into corresponding sockets such that the latching hooks can latch into corresponding hooking apparatuses and the part 28 of the plunger can protrude from the control panel or board. In contrast, FIG. 12 shows a contact element 13 which is designed for bottom attachment, for example in a housing or on a DIN rail. The inner structure of the contact element 13 substantially corresponds to the inner structure of the contact elements designed for front attachment. The plunger is merely fitted such that its part 28 protruding from the main body is positioned on the side of the main body facing away from the latching hooks oriented in the same direction, i.e. at the bottom of the main body, in contrast to the contact elements for front attachment, as can be seen by comparing the front-attachment contact element shown in FIG. 8-10 to the bottom-attachment contact element shown in FIG. 12. The contact element 13 is placed for example on a DIN rail such that the latching hooks hook onto the corresponding edges of the DIN rail. The part 28 of the plunger now protrudes, as it were, away from the latching hooks. The contact element 13 is particularly suitable for applications in which there are no suitable hooking options on the front side, for example when the contact element 13 is fitted into a housing comprising a housing cover without hooking apparatuses.

The present invention provides a contact element having a comparatively low installation depth, which can be used instead of conventional contact elements that have a substantially larger installation depth, for example in control panels or boards that have a smaller installation depth than conventional control panels and boards. In particular, it is possible to provide contact elements having an installation depth of less than 30 mm, in particular for installation in displays.

While the invention has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below. Additionally, statements made herein characterizing the invention refer to an embodiment of the invention and not necessarily all embodiments.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B, and C" should be interpreted as one or more of a group of elements consisting of A, B, and C, and should not be interpreted as requiring at least one of each of the listed elements A, B, and C, regardless of whether A, B, and C are related as categories or otherwise. Moreover, the recitation of "A, B, and/or C" or "at least one of A, B, or C" should be interpreted as including any singular entity from the listed elements, e.g., A, any subset from the listed elements, e.g., A and B, or the entire list of elements A, B, and C.

LIST OF REFERENCE SIGNS

10 NC contact element (normally closed contact)
11 NO contact element (normally open contact)
12 main body (housing) of the contact element 10 and 11
13 contact element for bottom attachment
14 left-hand terminal for electrical conductors
16 right-hand terminal for electrical conductors (identical part to terminal 15)
18 central bearing in the main body 12
20 left-hand busbar (normally closed contact)
21 left-hand busbar (normally open contact)
22 right-hand busbar (normally closed contact) (identical part to busbar 20)
23 right-hand busbar (normally open contact) (identical part to busbar 21)
24 plunger
25 plunger bottom
26 contact bridge
28 part of the plunger 24 protruding from the main body 12
30 return spring for the plunger 24
32 contact spring
34 central hole in the plunger 24
36 first side hole in the plunger 24
38 second side hole in the plunger 24
40 elongate opening in the left-hand side of the plunger 24
42 elongate opening in the right-hand side of the plunger 24
44 contact end of the contact bridge 26
46 contact end of the contact bridge 26
48 assembly opening for contact bridge 26
50 assembly opening for contact bridge 26
52 latching hook
54 latching hook
56 spring clamp
58 spring clamp (identical part to spring claim 56)
60 cover of the main body 12
62 auxiliary surface for releasing the contact element
64 inspection opening for measuring purposes
66 conductor lead-in
68 button actuator
70 conventional contact element
72 button

The invention claimed is:

1. A contact element, comprising:

a main body;

a first terminal and a second terminal, suitable for electrical conductors, which terminals are obliquely mounted in the main body;

a first busbar and a second busbar, each electrically connected to one of the terminals and extending from the respective terminal to a central bearing arranged centrally in the main body; and a plunger, which is spring-mounted in the central bearing, the plunger being moveable between a first and a second position and the plunger supporting a contact bridge, which electrically short-circuits the first and second busbars in one of the two positions, wherein a part of the plunger protruding from the main body is configured to couple to a button, wherein the plunger includes a central hole and a side hole, provided beside the central hole, wherein the central hole is configured to receive and mount a contact spring, which contact spring exerts a spring pressure on the contact bridge, wherein the side hole is configured to receive and mount a return spring, which return spring presses the plunger into the first or second contact position, wherein the contact bridge is mounted in the central hole, wherein the plunger includes an elongate opening in each of two opposite sides, through each of which contact ends of the contact bridge protrude, and wherein the plunger includes on an underside thereof, on each of the two opposite sides, an assembly opening for installing the contact bridge.

2. The contact element of claim 1, wherein the assembly openings are in the shape of small slits, which open the elongated openings towards a bottom of the plunger.

3. The contact element of claim 1, wherein the contact bridge is spring-mounted in the plunger.

4. The contact element of claim 1, wherein the plunger includes a further side hole, wherein the side hole and the further side holes are arranged symmetrically to the central hole.

5. The contact element of claim 1, wherein the main body includes a latching hook on each of two opposite sides thereof.

6. The contact element of claim 5, configured for front attachment, the part of the plunger protruding from the main body being positioned on a side of the main body facing the latching hooks, which are oriented in a same direction.

7. The contact element of claim 5, configured for bottom attachment, the part of the plunger protruding from the main body being positioned on a side of the main body facing away from the latching hooks, which are oriented in a same direction.

8. The contact element of claim 1, configured such that an installation depth thereof remains below 30 mm.

9. The contact element of claim 1, wherein the plunger includes more than one side hole.

10. The contact element of claim 8, wherein the installation depth is approximately 14 mm.

* * * * *